United States Patent [19]

Stritzl et al.

[11] Patent Number: 5,050,903

[45] Date of Patent: Sep. 24, 1991

[54] BUILDING UNIT FOR SAFETY SKI BINDING

[75] Inventors: Karl Stritzl, Vienna; Franz Luschnig, Traiskirchen; Henry Freisinger, Vienna, all of Austria

[73] Assignee: TMC Corporation, Baar/Zug, Switzerland

[21] Appl. No.: 382,793

[22] PCT Filed: Oct. 31, 1988

[86] PCT No.: PCT/EP88/00988

§ 371 Date: Jun. 21, 1989

§ 102(e) Date: Jun. 21, 1989

[87] PCT Pub. No.: WO89/04195

PCT Pub. Date: May 18, 1989

[30] Foreign Application Priority Data

Nov. 12, 1987 [AT] Austria ..... 2997/87

[51] Int. Cl.[5] ..... A63C 9/085

[52] U.S. Cl. ..... 280/625; 280/629

[58] Field of Search ..... 280/623, 625, 626, 628, 280/629, 634, 635, 636

[56] References Cited

U.S. PATENT DOCUMENTS 3,902,730 9/1975 Ischida et al. ..... 280/623
4,449,730 5/1984 Oberleitner et al. ..... 280/625
4,735,435 4/1988 Hornschemeger et al. ..... 280/625

FOREIGN PATENT DOCUMENTS 372616 4/1982 Austria .
0025747 3/1981 European Pat. Off. .
2548031 1/1985 France .
2553672 4/1985 France .

*Primary Examiner*—Andres Kashnikow
*Assistant Examiner*—Richard Camby
*Attorney, Agent, or Firm*—Finnegan, Henderson, Farabow, Garrett & Dunner

[57] ABSTRACT

The invention relates to a holding unit, in particular a toe unit, for safety ski bindings, which has a sole hold-down arranged on a bolt and two angle levers pivotably mounted about a spindle each, arranged on a supporting member, the angle levers being adapted to swivel out to the side against the force of a spring. The sole hold-down is adapted to move upwards against the force of the spring when there is a force acting vertically upwards on it, via a compensating lever, which bears against one of the angle levers each either directly or with an intermediate lever interposed. The bolt is guided displaceably in the vertical direction and, if there is an overload, is acted on by a wedge element which is guided on the supporting member and against which the ski boot bears.

In this arrangement there is a compensation for the frictional forces additionally occuring on the sole hold-down in the event of a twisting fall both backwards and forwards.

According to the invention, to support the ski boot, the wedge element is equipped with two support rollers and is connected to a guide bolt, which is arranged longitudinally movably in a sleeve-shaped tie rod acting on the angle levers.

10 Claims, 3 Drawing Sheets

BUILDING UNIT FOR SAFETY SKI BINDING

BACKGROUND OF THE INVENTION

1. Field of the Invention

The invention relates to a holding unit, in particular a toe unit, for safety ski bindings, which has a sole hold-down arranged on a bolt and two angle levers. The angle levers are pivotably mounted about a spindle each, arranged on a supporting member, and being adapted to swivel out to the side against the force of a spring. The sole hold-down is adapted to move upwards against the force of the spring when there is a force acting vertically on it and away from the upper side of the ski (upwards), via a compensating lever, which is designed as a two-armed lever and is mounted to swivel about a bearing spindle arranged on the supporting member. The compensating lever has at least on its one arm two preferably mutually parallel running arm sections, of which each, at least in the descent position of the holding unit, bears against one of the angle levers each either directly or with an intermediate lever interposed. The compensating lever is supported resiliently by its other arm with respect to the sole hold-down and is connected articulatedly to the bolt. The bolt is guided displaceably in the vertical direction, the range of movement of the sole hold-down being limited upwards by a stop, and there being guided displaceably in the longitudinal direction of the ski on the supporting member a wedge element. When the ski boot fitted into the holding unit, the wedge element bears against the ski boot sole. At least one sloping surface of the wedge element interacts with at least one sloping surface of a support part, which is secured against displacement at the bolt supporting the sole hold down.

2. Description of the Related Art

According to Austrian Patent No 372.616, a tie rod is provided, which passes through the supporting member, and acts at one end against the two angle levers and is acted upon at the other end by a spring which can be adjusted in its pretension by means of an adjusting screw.

According to the main patent, in a toe unit, a compensation of the frictional forces additionally occurring during a twisting fall both backwards and forwards on the sole hold-down is ensured. Consequently, a constant releasing force is assured for all possible twisting fall directions.

However. with this solution it was not possible to also initiate the compensation whenever an excessive force loading occurred only in the longitudinal direction of the ski, since the two lateral angle levers were blocked against such a force due to their design. The ski boot sole, in the running position, bore against regions of the individual angle levers running within the two bolts designed as spindles, so that the levers were acted upon by the ski boot sole in the closing direction. Only when a deflection of the one angle lever was initiated and the force component acting in the longitudinal direction of the ski already overcame the blocking angle was a compensation initiated - for example in the event of a forward twisting fall.

SUMMARY OF THE INVENTION

By the present invention it is intended that a compensation of the frictional forces additionally occurring between the ski boot sole and the angle levers also takes place when forces act exclusively in the longitudinal direction of the ski.

The features of the present invention serve to separate the support the ski boot sole on the angle levers and on the wedge element. As a result, the ski boot can also displace the wedge element when a force acts exclusively in the direction of the longitudinal axis of the ski, the wedge element for its part displacing in a known way the support part and, via the latter, the bolt in the vertical direction. In this manner the compensating lever is swivelled and the two angle levers are pushed slightly apart against the force of the spring. The angle levers are thus relieved, thereby facilitating the release of the ski boot. Hence, as desired, a compensation also takes place of those frictional forces which additionally occur when there is an overloading acting exclusively in the longitudinal direction of the ski between the angle levers and the ski boot sole. If this overloading stops without a release at the sides having taken place, the system returns to the initial position. The ski boot sole is again also held by the angle levers.

The features of the present invention also ensure a centering of the ski boot in the holding unit during running even when, due to a forward movement of the ski boot, the two angle levers have opened and thus released the ski boot at the sides.

The present invention also has the effect of achieving a particularly compact design of the holding unit.

Further, the invention insures the guidance of the wedge element without use of additional components.

Particularly favorable developments of the design and the mounting of tie rod and guide bolt are produced by the invention.

In accordance with the present invention there is provided a simple and reliable connection of the guide bolt to the wedge element and an arrangement of the wedge element relative to the slide.

BRIEF DESCRIPTION OF THE DRAWINGS

Further features, advantages and details of the invention are now described in more detail with reference to the drawing, which represents an exemplary embodiment. In the drawing.

DESCRIPTION OF THE PREFERRED EMBODIMENTS

Figure 1:
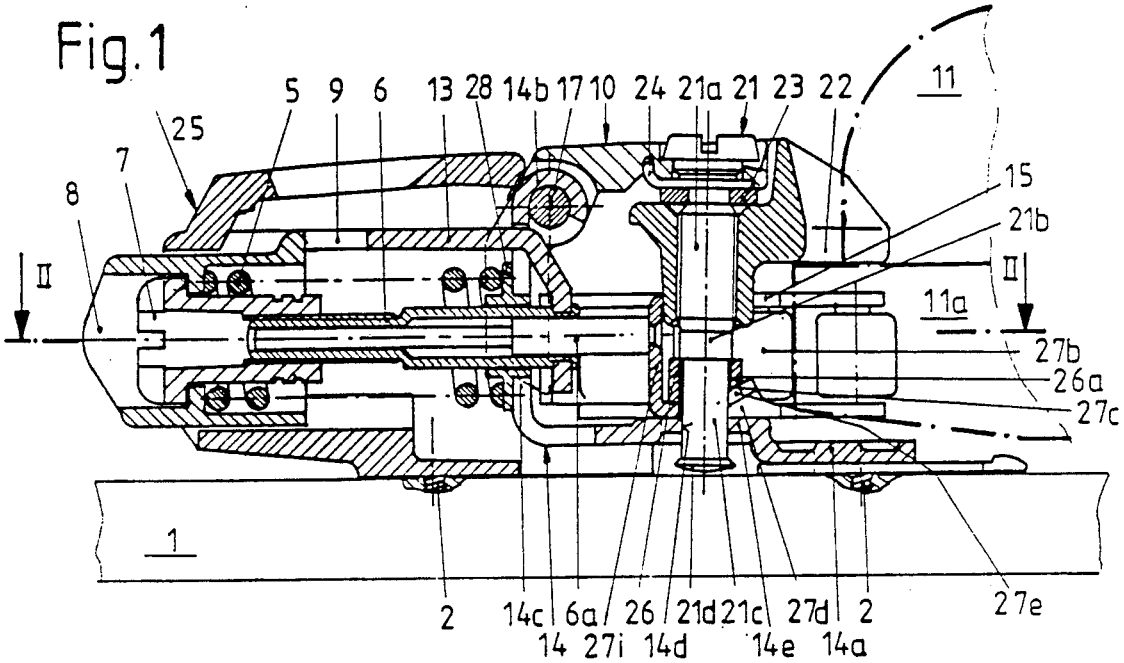
FIGS. 1 and 2 show the toe unit according to the invention in the running position of FIG. 1 being a side view in section and FIG. 2 being a section along the line II-II of FIG. 1.
Figure 2:
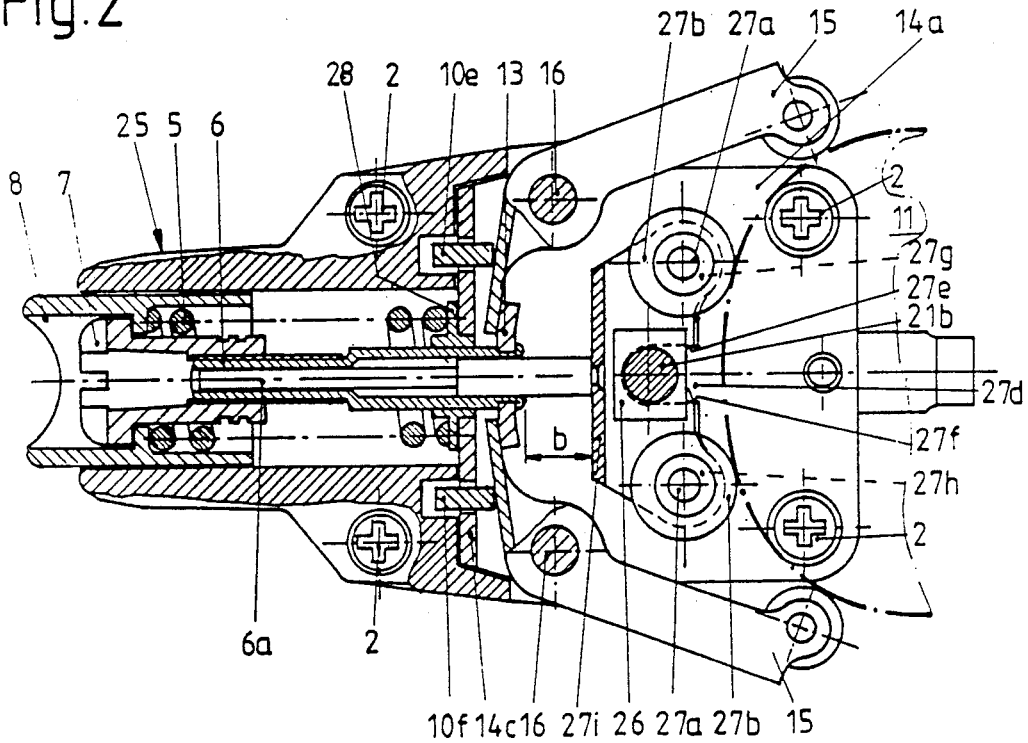

On ski 1, a supporting member 14 is fastened by its region designed as supporting plate 14*a* by means of screws 2. The supporting member 14 may also be arranged on a baseplate, which is displaceable in the longitudinal direction of the ski in a way known per se on a guide rail fixed to the ski and adapted to lock in various positions. The supporting member 14 bears angle levers 15, known per se, by means of bolts 16 designed as spindles, which levers are mounted so as to swivel about the bolts. At its end region facing the ski tip, the supporting member 14 is designed as a wall 14*c* which is substantially at a right angle to the upper side of the ski 1 and is made in its upper region as a bearing sleeve 14*b*. Bearing sleeve 14*b* forms, by means of a bearing spindle 17, a swiveling connection to a compensating lever 10 designed as a two-armed lever. This structure will be described in further detail with reference to FIG. 5.

Figure 3:
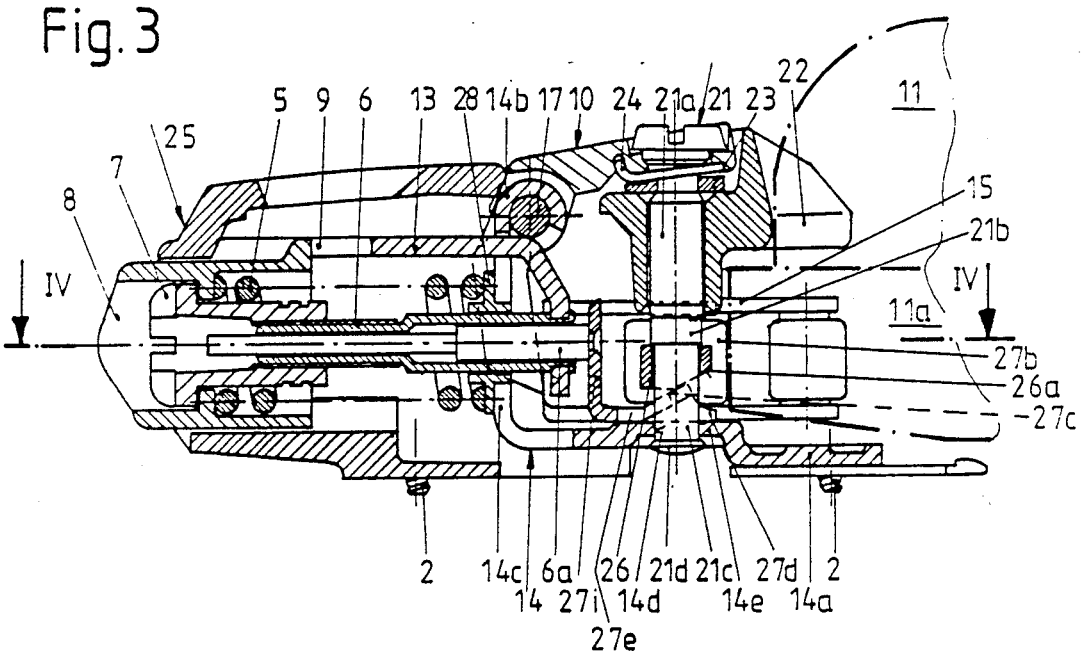
FIGS. 3 and 4 correspond to FIGS. 1 and 2 which show the toe unit a force acting on the toe unit in the longitudinal direction of the ski, FIG. 3 being a side view in section and FIG. 4 being a section along the line IV-IV in FIG. 3.

A spring 5 acts with its one end on the wall 14*c* of the supporting member 14, the other end of the spring 5 being supported in a sleeve-shaped abutment 8. The pretension of the spring 5 is adjustable in a way known per se by means of an adjusting screw 7. The respective spring adjustment can be read off on a display device 9, known per se, indicated in FIGS. 1 and 3.

A sleeve-shaped tie rod 6, through which a guide bolt 6*a* passes, is arranged coaxially to the compression spring 5, is anchored at one end in the adjusting screw 7 and is fastened at the other end on a slide 13, which acts on the angle levers 15. Considered in its longitudinal direction and as known per se, the tie rod 6 is subdivided into two sections, of which one section is provided with an external thread and engages in the adjusting screw 7 and the second section is designed with a smooth outer surface and is guided longitudinally displaceably in a guide bush 28 fixed in the wall 14*c* of the supporting member 14. The guide bush simultaneously serves as abutment for the spring 5 and the guide bolt 6*a* is displaceably mounted within tie rod 6 for longitudinal movement. The toe unit is surrounded for the most part by a housing 25.

A sole hold-down 22 for the ski boot sole 11*a* of a ski boot 11 is mounted pivotably on a bolt 21, the compensating lever 10 also being arranged on the bolt 21 by means of its one arm, which is designed as a bar-like fastening part 10*b*. Between the sole hold-down 22 and the fastening part 10*b* there are arranged a flexible element 23 and a retaining ring 24. The upper section 21*a* of the bolt 21 is provided with a thread, which engages in a counterthread of the sole hold-down 22, and with a screw head, whereby the sole hold-down 22 can be adapted to a variety of ski boot sole heights. The upper section 21*a* of the bolt 21 is adjoined in the direction of the upper side of the ski by a short middle section 21*b* having a smooth surface. Middle section 21*b* is adjoined by a lower section 21*c* of a smaller diameter, the lower section 21*c* likewise having a smooth surface. The lower section 21*c* of the bolt 21 passes through a bore 14*d* of the supporting plate 14*a*, which has in this region an inverted U-shaped, upwardly reduced embossing 14*e*. The lower-most end of the bolt 21 is provided with a rivet head 21*d*, the diameter of which is greater than the diameter of the bore 14*d*.

Figure 5:
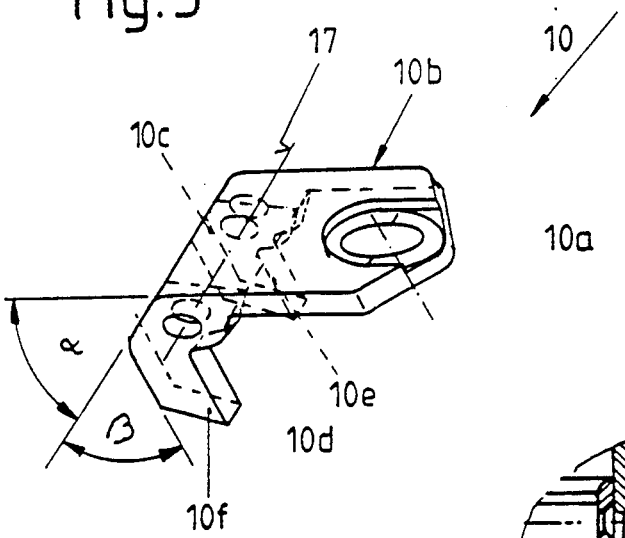
FIG. 5 shows a compensating lever of the present invention in oblique view.

As is evident in detail from FIG. 5, the compensating lever 10, considered in side view, is shaped as a two-armed lever, the one, approximately horizontally running arm of which consists of the fastening part 10*b* and the other, substantially vertically running arm 10*a* has two, approximately mutually parallel running arm sections consisting of two subsections in each case, 10*c*, 10*e* and 10*d*, 10*f* respectively. In this arrangement, the first two subsections 10*c*, 10*d*, adjoining the fastening part 10*b*, run at an acute angle $\alpha$ to the fastening part 10*b*, whereas the second, freely projecting subsections 10*e*, 10*f*, adjoining the first two sections 10*c*, 10*d* are bent off with respect to the said first subsections at an angle $\beta$. The size of the individual angles $\alpha$, $\beta$ is chosen such that, in the running position of the toe unit, the two freely projecting subsections 10*e*, 10*f* run substantially vertically, pass through clearances, not designated in any more detail, in the wall 14*c* of the supporting member 14 and bear each against one of the angle levers 15. The bearing spindle 17 passes through the first two subsections 10*c*, 10*d* of the individual arm sections 10*c*, 10*e* and 10*d*, 10*f* of the compensating lever 10, which is articulated so as to swivel via the bearing spindle 17 on the bearing sleeve 14*b* of the supporting member 14.

Figure 7:
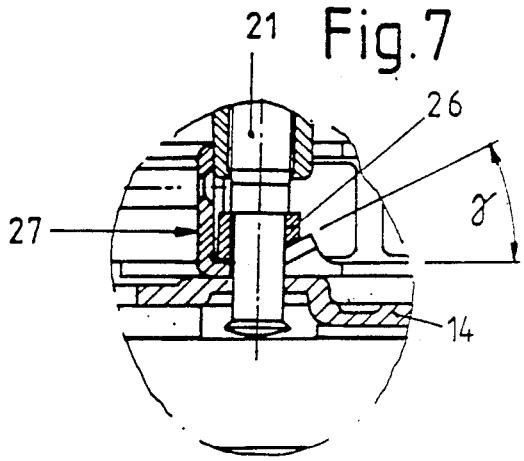
FIG. 7 is a detailed view of a portion of FIG. 1.

On the upper side of the embossing 14*e* of the supporting member 14 there is displaceably guided in a way still to be described in more detail a wedge element 27, connected to the guide bolt 6*a* of the tie rod 6 by means of its front wall 27*i*. The wedge element 27 bears on its side facing the ski boot 11 two axis bolts 27*a*, on which there is arranged in each case a support roller 27*b*, against which the ski boot sole 11*a* bears—when the ski boot 11 is fitted into the holding unit. The wedge element 27 has between its two support rollers 27*b* a clearance 27*d*, running in the longitudinal direction of the ski, which is provided for receiving the bolt 21 and allows a longitudinal displacement of the wedge element 27 on the supporting member 14 relative to the bolt 21. In this case, the two side walls 27*e*, 27*f* of the clearance 27*d* run from the diameter of the bolt 21 in the direction of the ski boot 11 in a plane in each case and substantially parallel to each other, thereby producing a guide for the wedge element 27 on the bolt 21. The two subregions 27*g*, 27*h*, adjoining the clearance 27*d*, of the wedge element 27 are provided with sloping surfaces 27*c*, each one running at an acute angle $\gamma$ of approximately 30° with respect to the upper side of the ski (cf. FIG. 7). On the sloping surfaces 27*c* of the wedge element 27 there rest sloping surfaces 26*a* of a support part 26. The support part 26 is pushed onto the lower section 21*c* of the bolt 21 and is held in position on the bolt 21 at one end by the wedge element 27 and at the other end by the flange-like widened diameter of the middle section 21*b* of the bolt 21. In this arrangement, the wedge element 27 has the upright front wall 27*i*, in which the guide bolt 6*a* is anchored, on its side facing away from the two axis bolts 27*a*.

The movement sequence in the event of a purely horizontal release is as follows: if one of the angle levers 15 is horizontally loaded, it swivels outwards about its associated bolt 16. During this swiveling movement, the slide 13 acting on the angle lever 15 is displaced together with the tie rod 6, the adjusting screw 7 and the abutment 8 in the longitudinal direction of the ski towards the sole hold-down 22, and the spring 5 is compressed.

If a backward twisting fall takes place, the ski boot 11 acts with a vertically upwardly directed force on the sole hold-down 22. By this force effect, the compensating lever 10, connected to the sole hold-down 22, swivels counterclockwise about the bearing spindle 17, the two free subsections 10*e*, 10*f* of the compensating lever 10 acting upon the angle levers 15, so that they swivel outwards about their bolts 16. The swiveling movement of the angle levers 15 has as a consequence a slide movement, as occurs in the case of a horizontal release, and the spring 5 is compressed. The movement of the sole hold-down 22, or the swiveling range of the compensating lever 10, is limited by the stopping of the rivet head 21*d* of the bolt 21 against the embossing 14*e* of the supporting plate 14. The resilient element 23 allows the swiveling movement of the compensating lever 10 without moving the sole hold-down 22 out of its position relative to the upper side of the ski.

In the event of a forward twisting fall, the ski boot sole 11*a* acts both on one of the angle levers 15 and on the wedge element 27 and displaces the latter on the supporting member 14 in the direction of the ski tip. The support part 26, with it the bolt 21, is moved upwards via the mutually interacting sloping surfaces 27*a* of the wedge element 27 and 26*a* of the support part 26. The entrainment of the bolt 21 is ensured by the middle section 21*b* of the bolt 21. As a result, the compensating lever 10, connected to the sole hold-down 22, swivels counterclockwise about the bearing spindle 17, the two arm sections 10*e*, 10*f* of the compensating lever 10 act on the angle levers 15, so that the latter swivel outwards about the bolts 16. The movement sequence taking place above the compensating lever 10 consequently corresponds to that occurring in the case of a backward twisting fall, as has already been described.

Consequently, the additional frictional force occurring both in the event of a backward twisting fall and in the event of a forward twisting fall between the ski boot sole 11*a* and the angle levers 15 is compensated for by the facilitated release of the angle levers 15 bearing laterally against the ski boot 11, the releasing force thus remaining constant, i.e. it corresponds to that of a purely horizontal release. These measures are known per se from the main patent and are realized, as described, also in the case of the present solution.

Figure 4:
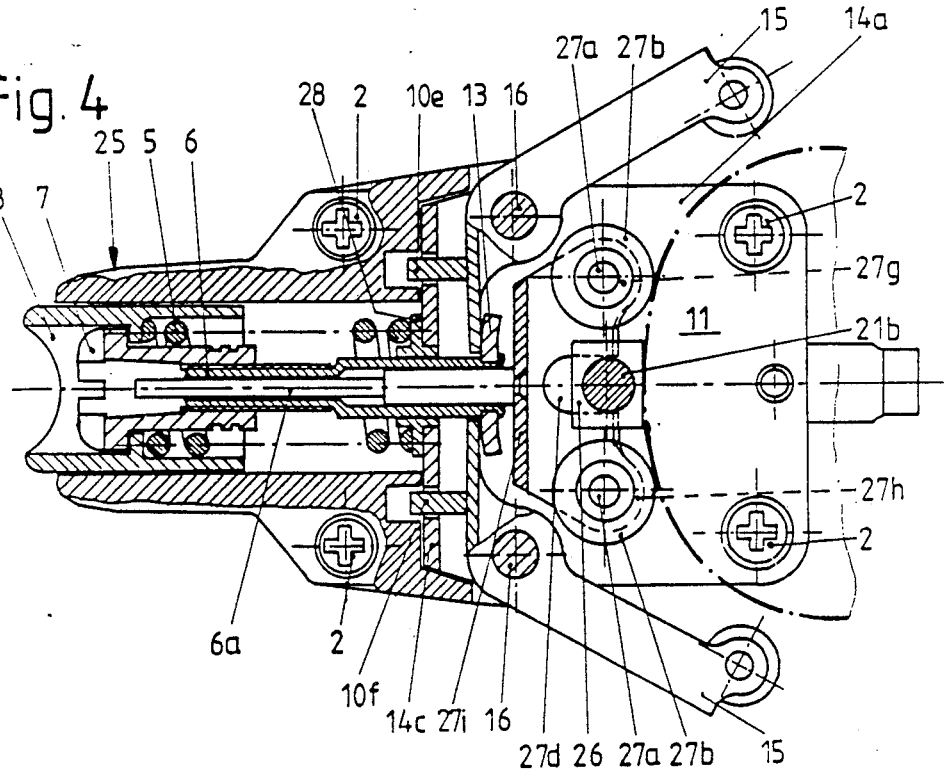
Figure 6:
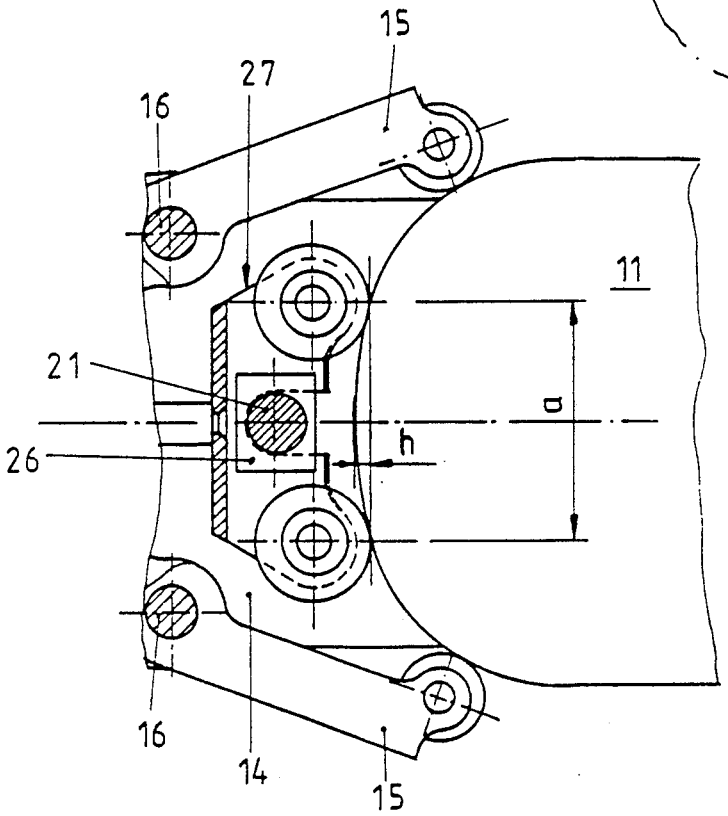
FIG. 6 is a detail portion of FIG. 2

As a result of the development according to the invention, it is ensured that a compensation is also initiated when there is a pure forward pushing movement of the ski boot 11. This occurs in the event of a pure forward fall, because displacement of the wedge element 27 serves to swivel the two angle levers 15 in the way described in the case of a forward twisting fall even if neither of the two angle levers 15 is acted on by the ski boot 11, cf. FIGS. 3 and 4. In this case, the ski boot 11 is held centered only by the two support rollers 27*b* of the wedge element 27, as evident from FIG. 4. Evident from FIG. 6 is the center-to-center distance a of the two axis bolts 27*a* and the chord height h. The center-to-center distance a is 30–36 mm, the chord height h, i.e. the distance between the arc section of the ski boot sole 11*a* and the tangent to the boot of the two support rollers 27*b*, measured in the longitudinal axis of the holding unit, is 1.5–2.5 mm.

In the case of a toe unit according to the invention, there is therefore a constant releasing force in all possible releasing directions. The frictional forces occurring between the ski boot sole 11*a* and the sole hold-down 22, or the angle levers 15, are without influence on the releasing forces.

The mutually interacting sloping surfaces 26*a*, 27*c* of the support part 26 and of the wedge element 27 are, in an advantageous way, coated with a material for reducing the sliding friction between these parts. The friction occurring between the underside 27*a* of the wedge element 27 and the upper side of the supporting member 14 can also be reduced by these components being coated or made with a friction-reducing material. The inclination of the sloping surfaces 26*a*, 27*c* relative to the upper side of the ski determines the extent of the force acting in the longitudinal direction of the ski on the compensating lever 10 and transferred from the latter onto the angle levers 15. In this respect, the designer is given a certain freedom, depending on the further design of the holding unit.

The invention is not restricted to the exemplary embodiment represented, in particular not to the toe unit described. The compensating lever and the wedge element interacting with the support part can be arranged on any toe unit having angle levers.

Various modifications are conceivable without departing from the scope of protection. The resilient element may also be arranged in the region between the compensating lever and that region of the supporting member on which the bolts of the angle levers are mounted. If the holding unit is arranged on a guide rail, the formation of an embossing on the supporting plate becomes superfluous, since there is sufficient space between the latter and the guide rail for the vertical movement of the stop of the bolt. To limit the vertical movement of the bolt, or of the sole hold-down, a stop could also be provided, for example on the housing.

We claim:

1. A toe holding unit for a safety ski binding, comprising:

spring means for exerting sole holding forces on various portions of the ski binding;

a bolt;

a sole hold-down moveable on said bolt in a substantially vertical direction with respect to an upper surface of a ski;

two angle levers for exerting lateral holding forces on the sole of a ski boot, said angle levers disposed in the holding unit for pivotal movement in a first direction toward a ski boot, and in a second direction away from a ski boot against the force of said spring means;

a compensating lever connected to said spring means and having a first arm connected to an end of said bolt, said compensating lever also having a second arm including two arm sections, each of said arm sections for operative engagement with one of said two angle levers, said spring means for urging said first arm of said compensating lever toward said hold-down to maintain said hold-down in a sole holding position;

a support part having a sloping surface, said support part being operatively connected to said compensating lever through said bolt; and a wedge element connected to said spring means and having at least one sloping surface for engagement with the sloping surface of the support part, the wedge element including two axis bolts each having a roller mounted thereon for bearing against the sole of a ski boot, said sloping surface of said wedge element for acting against the sloped surface of the support part to thereby urge the compensating lever to a releasing position in response to a force exerted on the wedge element through the rollers.

2. The holding unit as set forth in claim 1, wherein a center-to-center distance between the two axis bolts is 30–36 mm, and wherein, with a ski boot fitted in the holding unit, the chord height, being the distance between a line tangent to a tip of the sole extending transversely to the longitudinal direction of the ski and a straight line running parallel to the tangent line through points of contact of the two support rollers to the ski boot sole is 1.5–2.5 mm.

3. The holding unit as set forth in claim 1 or 2, wherein a clearance for receiving said bolt is formed between the two support rollers of the wedge element, the clearance extending in a longitudinal direction of the holding unit and being opened in the direction of the ski boot sole.

4. The holding unit as set forth in claim 3, wherein the clearance is rounded on a side facing away from the ski boot to correspond to an outer wall of the bolt, and wherein two side walls of the wedge element adjoining the rounded portion of the clearance extend substantially parallel to each other, and wherein said side walls serve as guides for the wedge element in the longitudinal direction of the ski on the outer wall of the bolt.

5. The holding unit as set forth in claim 1, wherein the spring means includes an adjusting screw, a spring, and a tie rod, the tie rod including two sections, one of said sections being provided with an external thread for engaging the adjusting screw and the second section including a smooth outer surface that is fastened on a slide, which acts on the angle levers, wherein the holding unit further includes a guide bush and a supporting member for supporting said guide bush, the tie rod being guided in said guide bush, and the guide bush serving as abutment for the spring.

6. The holding unit as set forth in claim 5, wherein the wedge element has on a side facing away from the two axis bolts an upright front wall in which an end portion of the tie rod is anchored, and wherein the upright front wall is spaced from the angle levers to permit unhindered pivotal movement of the angle levers.

7. A toe holding unit for a safety ski binding, comprising:

a sole hold-down moveable in a substantially vertical direction with respect to an upper surface of a ski, for contacting the sole of a ski boot;

two angle levers disposed in the toe holding unit for exerting lateral holding forces on the sole of a ski boot, said angle levers adapted for pivotal movement toward and away from a ski boot;

a compensating lever connected to an end of said bolt and having a first arm for engagement with said hold-down, and a second arm including two arm sections, each of said arm sections for operative engagement with one of said two angle levers;

spring means for urging said first arm of said compensating lever toward said hold-down to move said hold-down to a sole holding position;

a support part having a sloping surface, said support part being operatively connected to said compensating lever; and a wedge element having at least one sloping surface for engagement with the sloping surface of the support part, and having a portion for bearing against the sole of a ski boot, said sloped surface of said wedge element for acting against the sloped surface of the support part to thereby urge the compensating lever to a releasing position in response to a force exerted on the wedge element through the sole of a ski boot.

8. A toe holding unit as set forth in claim 1 further including an intermediate lever disposed between at least one of said angle levers and said compensating lever.

9. A toe holding unit as set forth in claim 1 wherein the bolt includes a surface extending transverse to its elongated axis, said support part having a portion for engaging said transverse surface.

10. A toe holding unit as set forth in claim 1 further including a supporting member having an opening disposed therein for receiving a distal end of the bolt, the bolt including a stop disposed on its distal end for preventing the bolt from being removed from the opening of the support part.

* * * * *

UNITED STATES PATENT AND TRADEMARK OFFICE

CERTIFICATE OF CORRECTION

PATENT NO. : 5,050,903

DATED : September 24, 1991

INVENTOR(S) : Karl STRITZL et al.

It is certified that error appears in the above-identified patent and that said Letters Patent is hereby corrected as shown below:

ON THE TITLE PAGE: Title, delete "BUILDING" and insert --HOLDING--.

Signed and Sealed this

Twelfth Day of January, 1993

*Attest:*

*Attesting Officer*

DOUGLAS B. COMER

*Acting Commissioner of Patents and Trademarks*